US007143482B2

(12) United States Patent
Sens-Grosholz et al.

(10) Patent No.: US 7,143,482 B2
(45) Date of Patent: Dec. 5, 2006

(54) NECKTIE BUTTON FOR A NECKTIE

(76) Inventors: Peer Sens-Grosholz, Schaffhauserstrasse 59, 8238 Büsingen (CH); Rene Rosenast, Egetswilerstrasse 100, 8302 Kloten (CH)

( * ) Notice: Subject to any disclaimer, the term of this patent is extended or adjusted under 35 U.S.C. 154(b) by 98 days.

(21) Appl. No.: 10/912,054

(22) Filed: Aug. 6, 2004

(65) Prior Publication Data

US 2005/0198785 A1 Sep. 15, 2005

(30) Foreign Application Priority Data

Mar. 9, 2004 (CH) ..... 00391/04

(51) Int. Cl.
*A41D 25/00* (2006.01)
*A41D 25/02* (2006.01)

(52) U.S. Cl. ..... 24/66.3; 24/65; 24/66.6; 2/148; 2/145

(58) Field of Classification Search ..... 24/66.3, 24/66.2, 66.4, 66.6, 66.7, 62, 65, 56, 66.13; 2/152.1, 145, 148
See application file for complete search history.

(56) References Cited

U.S. PATENT DOCUMENTS 2,631,292 A * 3/1953 Cunningham ..... 2/153
2,735,105 A * 2/1956 Traub ..... 2/150
2,735,106 A * 2/1956 Mercer ..... 2/150
3,958,277 A * 5/1976 Girdler ..... 2/153
5,864,882 A * 2/1999 Kowalyk ..... 2/148
5,920,907 A * 7/1999 Pierce ..... 2/152.1
5,953,755 A * 9/1999 Barylski ..... 2/148
6,094,746 A * 8/2000 Miller ..... 2/152.1
6,490,763 B1 * 12/2002 Tamura ..... 24/65
6,920,642 B1 * 7/2005 Dickens ..... 2/152.1

* cited by examiner

*Primary Examiner*—Robert J. Sandy
(74) *Attorney, Agent, or Firm*—Wenderoth, Lind & Ponack, L.L.P.

(57) ABSTRACT

A necktie button for a necktie (2) provided with a front button part (3) which defines the button shape and a rear part (4) which is able to be joined to the front button part (3) for holding the necktie (2) between these two parts (3, 4). The rear part (4) is designed as a clip part for clipping the necktie button on the shirt. Both parts (3, 4) are designed in a way that a necktie (2) made from a flexible material, folded at desired positions in a transverse direction with the folded end (2*a*) is able to be hung and/or clipped between the two parts (3, 4). In this way any elegant necktie button may be combined with an existing necktie.

14 Claims, 7 Drawing Sheets

NECKTIE BUTTON FOR A NECKTIE

BACKGROUND OF THE INVENTION

The invention concerns a necktie button for a necktie.

Conventional neckties consist mostly of a fabric and are tied. The disadvantage is the troublesome tying of the necktie, which not infrequently results in less than handsome tie knots. In the case of ties made from leather, plastics, silk, wood and other materials ready-made necktie buttons are also used, which are mostly hung with a band around the neck. In order to circumvent the disadvantages of tying the necktie and to avoid being "hung" by the neck, necktie buttons have also been developed for neckties which have been especially designed in only one strip, wherein the necktie is fastened respectively with one end between two parts of the necktie button which are able to be joined together, by which the front part of necktie button defines the button shape and the rear part is designed as a clip part for clipping the necktie button to the shirt. The necktie exhibits a hole at its end, with which it is pinned onto a pin assigned to one part and held by means of the other part.

The task underlying the present invention is to create a necktie button of the form mentioned at the start, with which the conventional neckties made from a flexible material may be clipped to the shirt, wherein it needs neither a special cutting, nor a necktie knot.

SUMMARY OF THE INVENTION

The necktie button according to the invention enables a rapid and comfortable attachment of a conventional or shortened necktie at the shirt collar. This must be tied around the neck with perfect fit and without the necktie having to be tied in a complicated manner. The necktie may be adjusted to any length. The material, the shape and the color of the necktie button and its front button part may be varied and enable thus a wide variety of fashionable combinations with various neckties. In a particularly preferred method, the front part of the button of the necktie button may be designed as a piece of jewelry or even serve advertising purposes. Additionally the necktie button may be provided with special adaptations, which are put onto to the button, attached or otherwise accommodated and thus bestows a new form the button.

BRIEF DESCRIPTION OF THE DRAWINGS

The invention will be explained in more detail as follows. The drawings show.

DETAILED DESCRIPTION OF THE INVENTION

Figure 1:
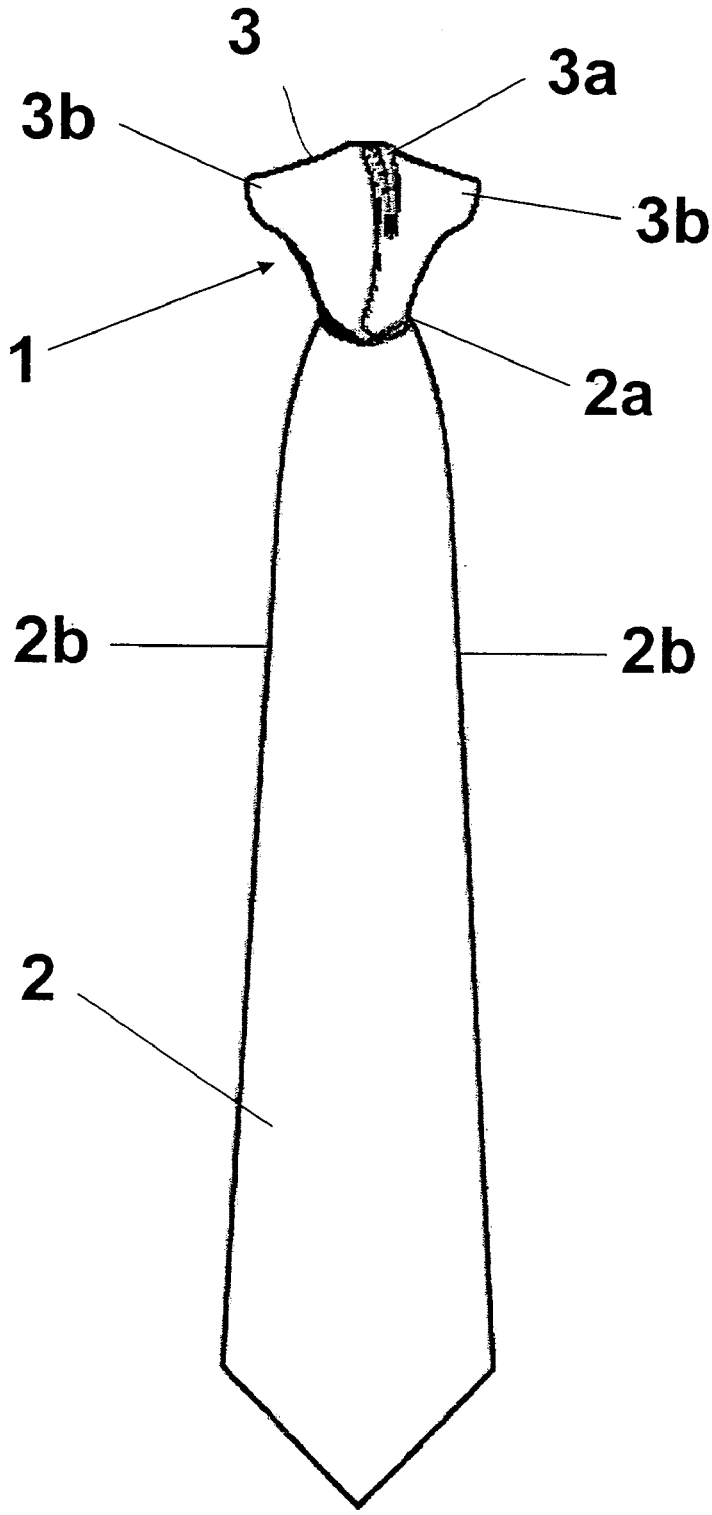
FIG. 1 is a front view of an example of a design for a necktie button according to the invention having a conventional or shortened necktie clipped with the button.
Figure 2:
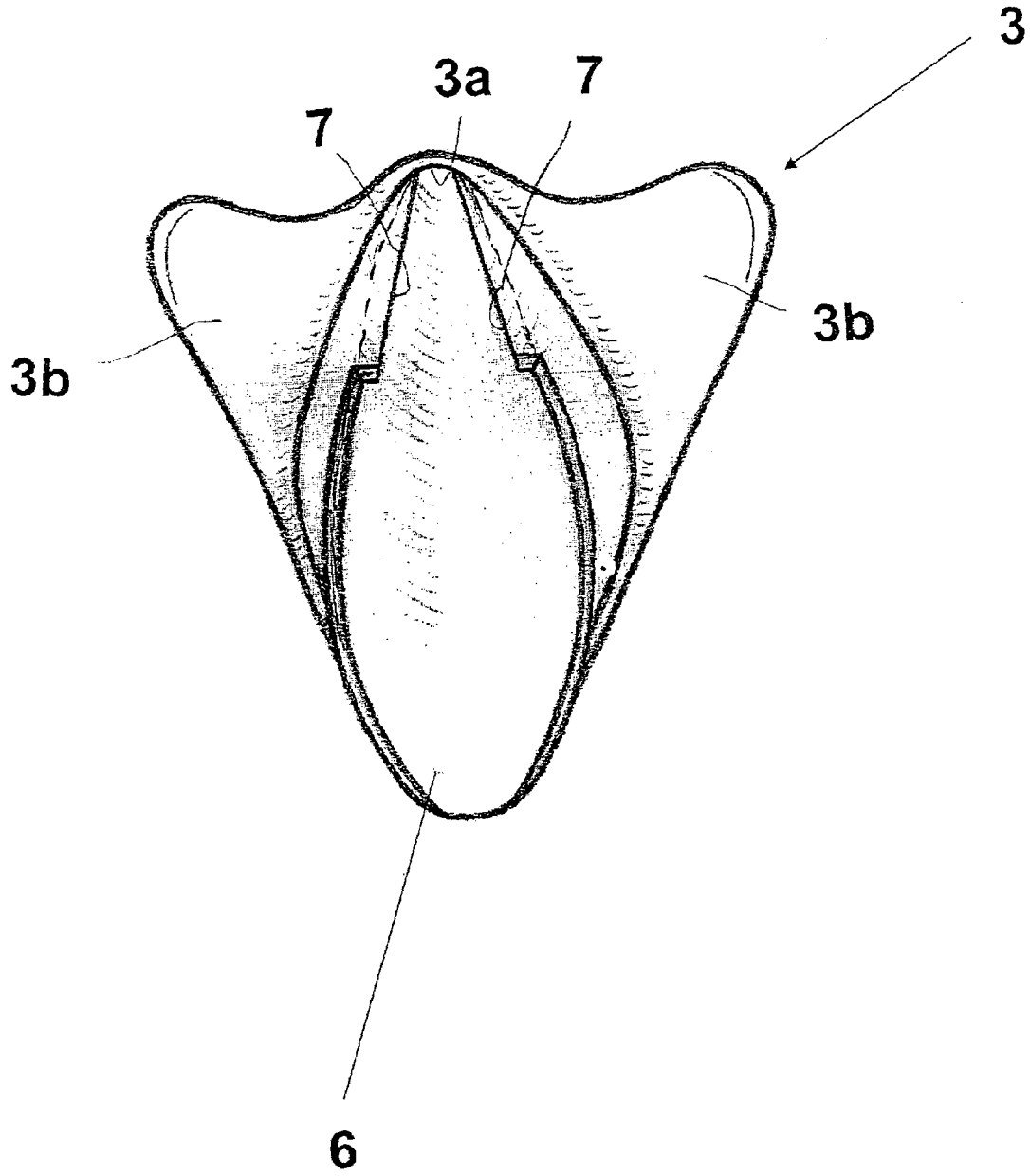
FIG. 2 is a rear perspective view of a front button part of the necktie button according to FIG. 1.

FIG. 1 shows a necktie button 1 for a necktie 2, in which it may concern a conventional or shortened necktie made from a flexible material, preferably fabric (textile, silk) or else even leather, plastics etc. The necktie button 1 consists of two parts which can be joined together, provided to secure the necktie 2, by which from FIG. 1 solely the front button part 3 which defines the button shape is visible, which is also shown in FIG. 2 and FIG. 4. A rear part of the necktie button 1 is designed as a clip part visible in FIGS. 3 and 5, which is equipped to clip with a clip 5 on the shirt collar or on the uppermost shirt button.

The front button part 3 exhibits a recess 6 according to FIG. 2 and FIG. 4 on its reverse side, which is open towards the bottom and, at the rear, two bars 7 appear to face each other at the sides. Towards the top, the recess 6 is closed off by a cambered wall 3*a* of the button part 3. The cambered wall 3*a* is part of a central part of the necktie button 1, which in the case of the illustrated embodiments exhibits something like the shape of a classical necktie button, to which two lateral extensions or wings 3*b* are connected to the central part. The front button part 3 is fabricated from a solid material, preferably from hard plastics.

Figure 3:
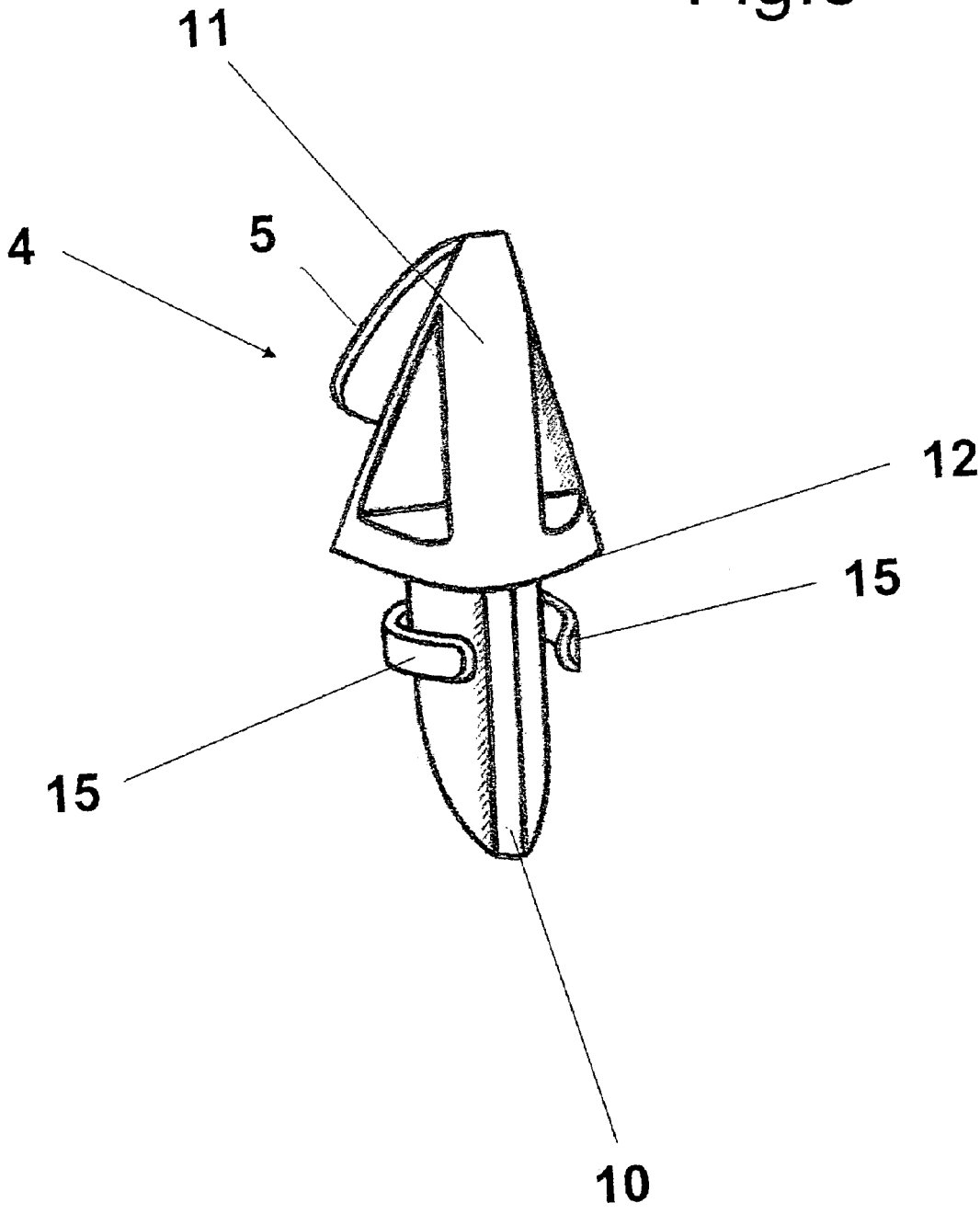
FIG. 3 is a perspective view of a rear clip part of the necktie according to FIG. 1.
Figure 4:
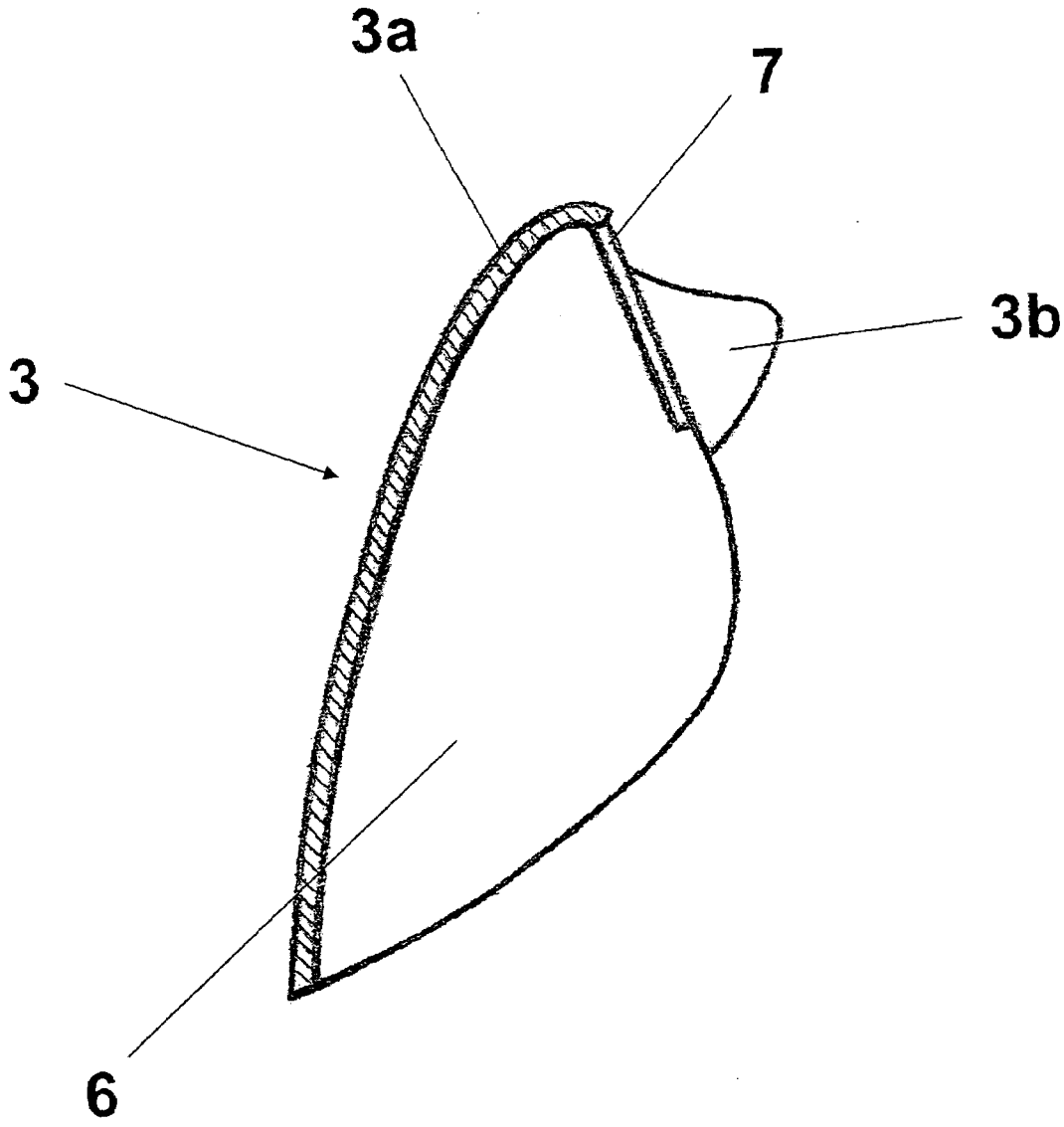
FIG. 4 is a longitudinal section of the front button part.
Figure 5:
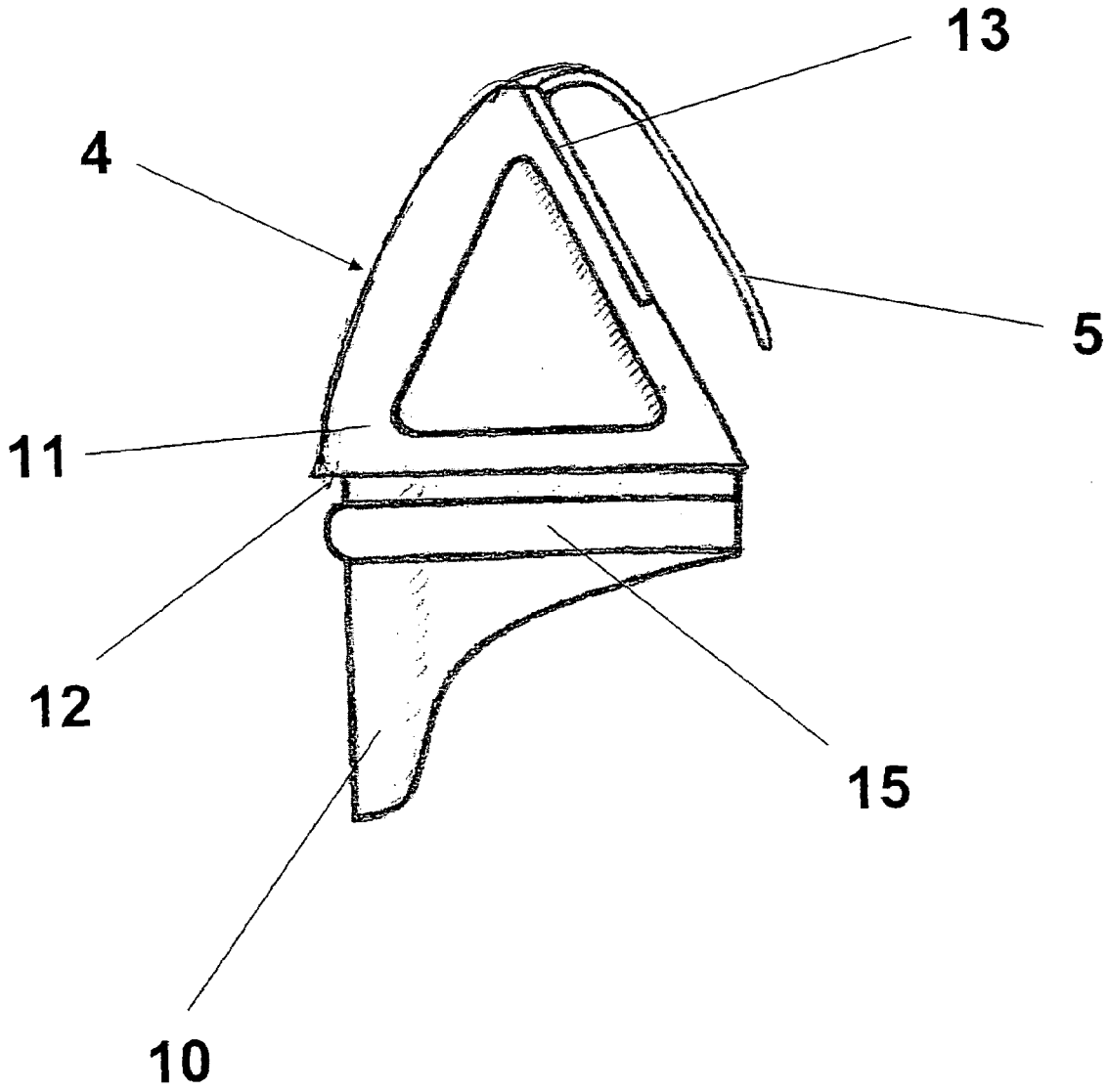
FIG. 5 is a side view of the rear clip part.

The clip part 4 fabricated from an elastic ductile material, preferably plastics or vulcanite, exhibits a kind of mushroom shape according to FIGS. 3 and 5, with a foot (based) 10 and head 11 cambered towards the front, between which a stepped (or shouldered) surface 12 is present. The front face of the clip head 11 corresponds to the recess 6 in shape as well as the cambered wall 3*a* of the front button part 3. On the reverse side the head 11 is provided with the previously mentioned clip 5. Clip 5 may exhibit a slit opening towards the bottom for securing on the uppermost shirt button, which however is not visible in the drawing. Nevertheless two lateral guide notches 13 are provided at head 11.

Two lateral clips or hangers 15 oriented towards the front, are arranged on the foot 10 of the clip part, which are provided to hold the necktie 2 to be secured in the necktie button 1. The necktie 2 is folded in one of the desired positions adapted to the body size in horizontal transverse direction, with its side edges 2*b* (FIG. 1) bent towards the rear around the foot front side of the clip part 4 and with the fold hanging on the hangers 15. The shoulder surface 12 thus forms the upper strike surface for the necktie 2.

The clip part 4 with the necktie 2 hung on the hangers 15 is pushed from below with the head 11 into the recess 6 of the front button part 3 under the combined effects of the guide bars 7 and the guide notches 13, until the head 11 is interlocked with the recess 6 and the cambered wall 3*a* and is thus held fast. Further additional interlocking means could be provided (a snap-in notch, or other such means).

The necktie 2 which is hung on the hangers 15 at any position is thus held fast or clamped with its folded end 2*a* (FIG. 1) in the gap between the recess 6 and the foot 10, wherein two superimposed necktie parts hang down from the necktie button 1 in the same way as one necktie tied around the neck. (only the front part of the necktie is visible from FIG. 1)

It is conceivable for there to be also purely a pinched gripping of the folded necktie 2 between the front button part 3 and the rear clip part 4—without hanging and without using hangers, although the necktie 2 in the case of the solution shown may be positioned perfectly in the necktie button 1. The clips could also theoretically be allocated to the front button part and for example could be arranged at the wings 3*b* of the same—extended towards the front. Also both necktie button parts could be joined in a different way to that shown.

The front button part 3 could exhibit any other form instead of the classical necktie button form (e.g., various cubic forms, a ball shape, ellipsoid etc.) and thus be worn as a jewelry piece, an advertising medium or an events logo.

The necktie button according to the invention could also be designed in the form of a sleeve or box, and the necktie pinched and/or clipped with its folded end between two coaxial cylindrical parts of the same.

Figure 6:
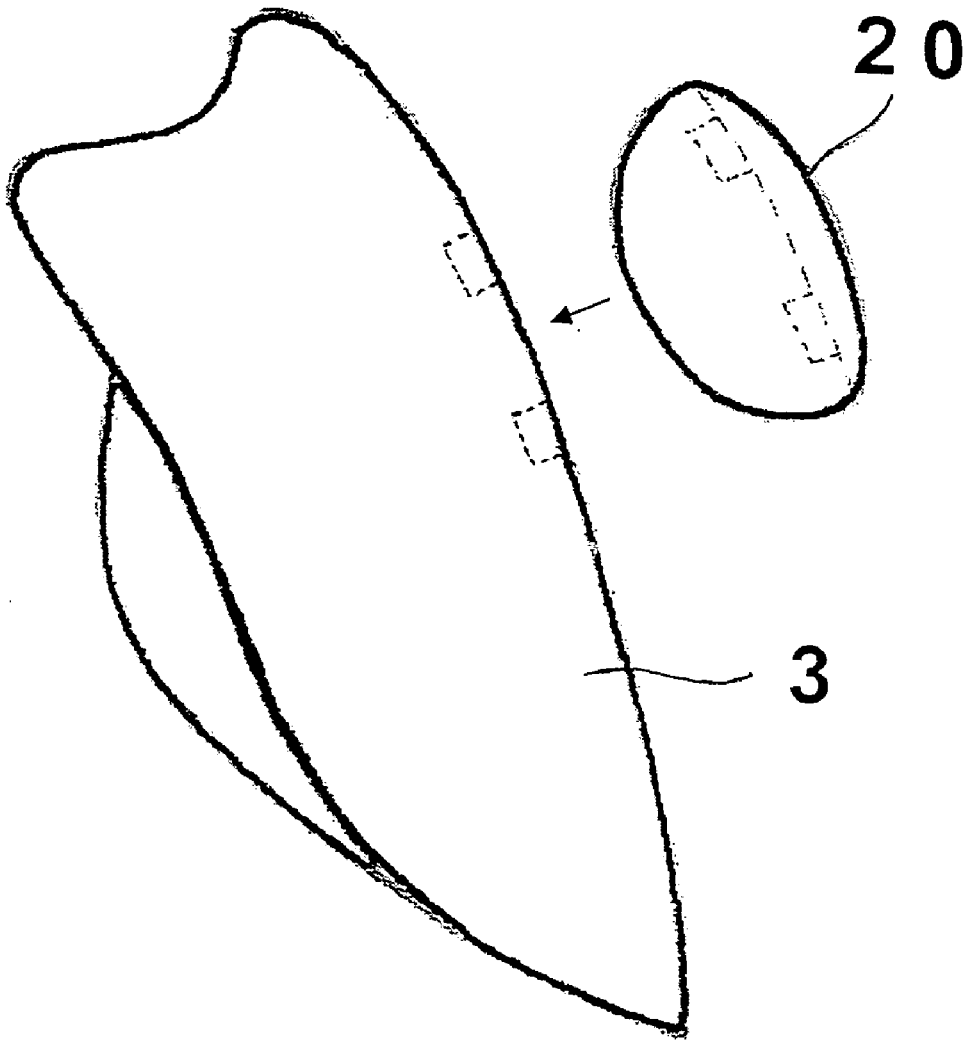
FIG. 6 is a side view of an additional embodiment form of the front button part, with a push-in adaptation.
Figure 7:
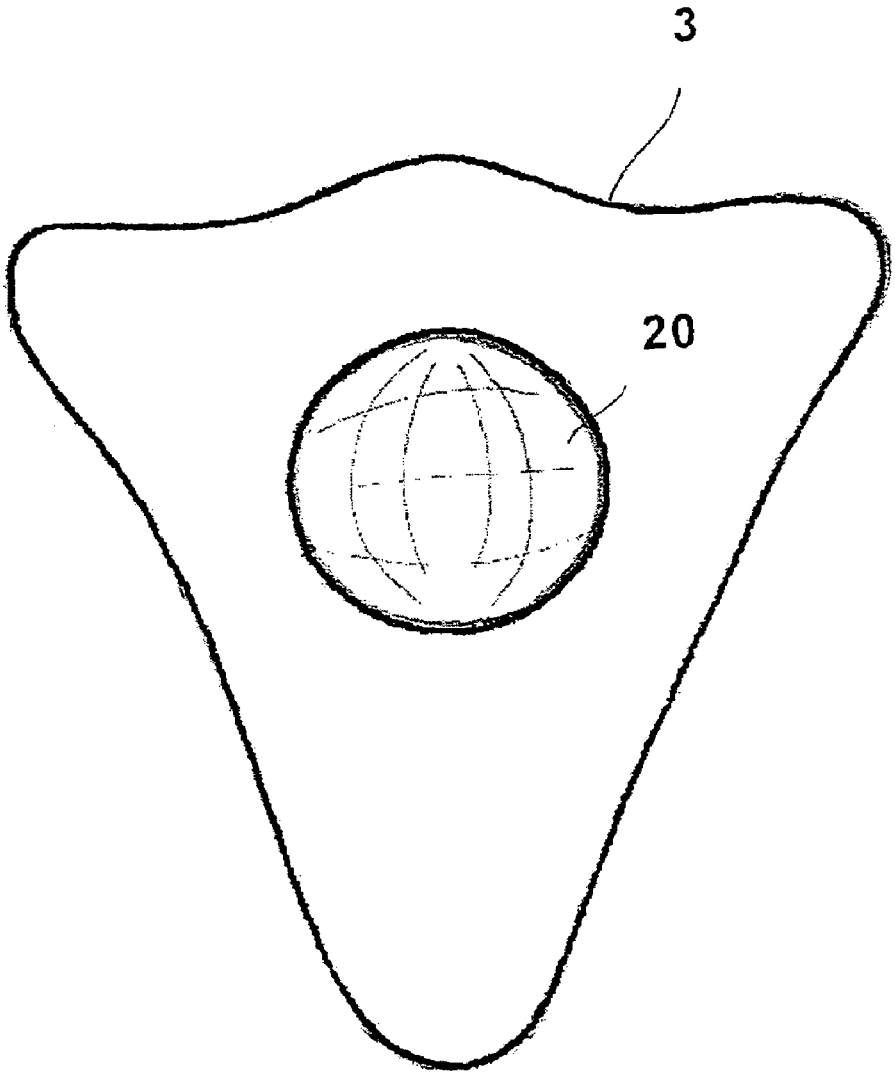
FIG. 7 is a front view of the button part according to FIG. 6 having the pushed-in adaptation.

As indicated in FIGS. 6 and 7 the necktie button according to the invention could also be provided with adaptations 20 with special varied forms, materials and functions which may be for example attached to the front part 3 (apart from decoration other, e.g. electronic functions such as watch, tie-watch, microphone, light diode etc.). The adaptations could also be attached to the front button part 3 or otherwise mounted.

An important advantage of the necktie button according to the invention is that the necktie does not have to be especially adapted for fastening (no opening or slit) and is also not damaged by fastening.

The necktie button according to the invention enables a rapid and comfortable attachment of a conventional necktie to the shirt collar, with perfect fit, without the necktie having to be tied in a complicated fashion and tied round the neck. The necktie may be adjusted to any length. Shorter length neckties may also be used. The material, the shape and the color of the necktie button in respect of its front part may vary, and thus enable a variety of fashionable combinations with different neckties. In an especially preferred method, the front button part of the necktie button may be designed as a piece of jewelry or serve advertising purposes (e.g. to be equipped with company logo etc). Several button parts could be in use with the same clip part by choice.

The invention claimed is:

1. A necktie button for a necktie, said necktie button comprising:

a front button part; and a rear clip part engagable with the front button part for holding fast the necktie between the rear clip part and the front button part, wherein the rear clip part includes a head portion, a foot portion extending below the head portion, a clip member for clipping the necktie button to a shirt; and a pair of hangers projecting from one of the front button part and the rear clip part for receiving thereon a folded portion of the necktie so as to suspend the necktie from the hangers, wherein the suspended necktie can be secured between the front button part and the rear clip part.

2. The necktie button according to claim 1, wherein the hangers are integrated with the rear clip part and extend therefrom in a forward direction.

3. The necktie button according to claim 2, wherein the front button part includes a rear recess and a pair of guide bars formed along an opening of the recess, and the rear clip part has a pair of guide notches formed on the head portion for receiving the guide bars when the head portion is pushed into the recess of the front button part.

4. The necktie button according to claim 2, wherein the rear clip part is formed of an elastic ductile material.

5. The necktie button according to claim 2, wherein the rear clip part is formed of plastic or vulcanite and is adapted to be attached to a collar of the shirt or on an uppermost button of the shirt.

6. The necktie button according to claim 2, wherein the rear clip part has a mushroom shape, and the hangers extend from opposite sides of the foot portion, and the head portion is able to be accommodated in an interlocking manner with the front button part, wherein a shoulder surface is provided between the head portion and the foot portion so as to form a strike surface for the necktie.

7. The necktie button according to claim 2, wherein each of the hangers is a curved structure.

8. The necktie button according to claim 7, wherein the front button part includes a rear recess and a pair of guide bars formed along an opening of the recess, and the rear clip part has a pair of guide notches formed on the head portion for receiving the guide bars when the head portion is pushed into the recess of the front button part.

9. The necktie button according to claim 8, wherein the clip member includes a slit that is open at a bottom of the clip member for securing the rear clip part on an uppermost shirt button.

10. The necktie button according to claim 1, wherein the hangers project, in a forward direction, from opposite sides of the foot portion of the rear clip part.

11. The necktie button according to claim 1, wherein the front button part has the appearance of a piece of jewelry.

12. The necktie button according to claim 1, wherein the front button part is an advertising medium.

13. The necktie button according to claim 1, wherein the front button part is provided with adaptations which are able to be secured thereto.

14. A necktie button for engaging a shirt and supporting a necktie in a suspended manner, said necktie button comprising:

a front button part; and a rear clip part engagable with the front button part for securing the necktie between the rear clip part and the front button part, wherein the rear clip part includes a head portion, a foot portion extending below the head portion, a clip member for clipping the necktie button to a shirt, and a necktie hanging structure projecting forwardly from the foot portion; and wherein the necktie hanging structure is adapted to receive thereon a folded portion of the necktie so as to suspend the necktie from the necktie hanging structure so that the suspended necktie can be secured between the front button part and the rear clip part.

* * * * *